United States Patent [19]

Knechtel

[11] 4,275,134

[45] Jun. 23, 1981

[54] ELECTROPHOTOGRAPHIC METHOD FOR REPRODUCING A MULTICOLOR IMAGE

[75] Inventor: Wilhelm Knechtel, Biebertal, Fed. Rep. of Germany

[73] Assignee: Canon Kabushiki Kaisha, Tokyo, Japan

[21] Appl. No.: 750,734

[22] Filed: Dec. 15, 1976

Related U.S. Application Data

[63] Continuation of Ser. No. 493,655, Jul. 30, 1974, abandoned.

[51] Int. Cl.[3] ..... G03G 13/01

[52] U.S. Cl. ..... 430/44; 430/47; 430/55; 355/4

[58] Field of Search ..... 96/1.4, 1.2, 45; 430/42, 46, 88, 47, 55, 66

[56] References Cited

U.S. PATENT DOCUMENTS

| | | | |
|---|---|---|---|
| 3,085,878 | 4/1963 | Archer | 96/45 |
| 3,438,706 | 4/1969 | Tanaka et al. | 96/1.4 |
| 3,457,070 | 7/1969 | Watanabe et al. | 96/1 R |
| 3,531,195 | 9/1970 | Tanaka et al. | 96/1.2 |
| 3,807,998 | 4/1974 | Kinoshita et al. | 96/1.2 |
| 3,832,169 | 8/1974 | Kinoshita et al. | 96/1 R |
| 3,832,170 | 8/1974 | Nagamatsu et al. | 96/1.2 |
| 3,904,406 | 9/1975 | Takahashi | 96/1.2 |
| 3,930,850 | 1/1976 | Matsumoto et al. | 96/1.2 |

*Primary Examiner*—Edward C. Kimlin
*Assistant Examiner*—John L. Goodrow
*Attorney, Agent, or Firm*—Fitzpatrick, Cella, Harper & Scinto

[57] ABSTRACT

In the practice of electrophotography using a photosensitive medium having an insulating layer on a photoconductive layer, the surface of the photosensitive medium is uniformly charged with a primary charge. The primary-charged surface of the photosensitive medium is then charged with a charge of the opposite polarity or discharged and simultaneously therewith or therebefore or thereafter, exposed to image light from an original. A grid image is projected upon the surface of the photosensitive medium. For multi-color representation these steps may be repeated in accordance with the number of colors desired.

4 Claims, 4 Drawing Figures

ELECTROPHOTOGRAPHIC METHOD FOR REPRODUCING A MULTICOLOR IMAGE

This is a continuation of application Ser. No. 493,655, filed July 30, 1974, now abandoned.

BACKGROUND OF THE INVENTION

1. Field of the Invention

This invention relates to an electrophotographic method and apparatus, and more particularly to a method and apparatus which can achieve good half-tone representation of monochromatic and multi-colored images.

2. Description of the Prior Art

Projection of an image divided into the form of meshes has heretofore been adopted to provide a good half-tone representation. Division of an image into such mesh form has usually been done by disposing a grid between an original to be copied and a glass plate supporting the original thereon or by providing the glass plate itself with grid lines.

The grid of this type must have a very large size, i.e. a size corresponding to that of the glass plate supporting the original. Formation of such grid is quite expensive.

Further, where a colored copy is to be produced, the grid must be rotated when each color-resolved image is projected. Otherwise, the resultant copy would exhibit a ripply pattern (moire stripes).

On the other hand, the original being copied must be maintained accurately in its position until each individual color-resolved image is formed and moreover, these individual color-resolved images must be projected in sufficiently accurate superposed relationship. These relationships are difficult to maintain when the grid is rotated. Further, the original to be copied is usually rectangular in shape and therefore, the grid must have a large surface area sufficient to fully cover the surface of the original in any of the successive rotated positions of grid. Accordingly, a large space must be provided for the grid.

There has also been proposed a method and apparatus which uses a photosensitive medium formed with a mesh-like pattern, instead of a grid formed in the original carrier. However, this is unsuitable and inconvenient for color representation because the mesh-like pattern is immovable during the color representation and the creation of moire stripes is unavoidable.

One of the methods heretofore employed for color representation is to repeatedly expose a sheet belt of zinc oxide to various color-resolved images of an original. During the interval between the individual exposure steps, the image is developed by means of a corresponding color developer and the copy paper is dried prior to the next charging step.

Another conventional method is to repeatedly expose a photosensitive medium disposed on the cylindrical surface of a drum to various color-resolved images of an original. In such cyclical process wherein charging, exposure, development, etc. are repeated to represent each resolved color, synchronism between conveyance of the copy paper and rotational speed of the drum is indispensable during the image transfer step.

Production of colored copies requires a number of steps to be repeated and the control mechanism therefor becomes complicated.

In achieving the above-described mesh-like image exposure, the conventional methods and apparatuses require additional steps and involve complicated construction as compared to the present invention.

SUMMARY OF THE INVENTION

It is an object of the present invention to provide an electrophotographic method and apparatus which can accomplish image representation with a half-tone effect.

It is another object of the present invention to provide an electrophotographic method and apparatus which can accomplish image representation through simple process steps.

It is still another object of the present invention to provide an apparatus which is compact in construction and which accomplishes multi-color image representation with a half-tone effect.

The present invention uses a photosensitive medium having an insulating layer on a photoconductive layer. A primary charge is applied to the surface of the insulating layer, image exposure is effected thereon and simultaneously therewith or therebefore or thereafter, a charge of the opposite polarity or AC corona discharge is applied to the insulating layer, whereafter during overall exposure the insulating layer is exposed to a mesh-like pattern, and is then developed.

A basic process applicable for use in the latent image forming portion of the above-described process, prior to the mesh-like exposure, is disclosed, for example, in U.S. Pat. No. 3,666,363 issued to Hiroshi Tanaka et al May 30, 1972 (British Pat. No. 1,165,406).

The use of such process of the present invention provides good half-tone representation without requiring any additional steps.

Further, where color representation is desired, the apparatus may be designed such that grid images disposed with different angles of projection are projected during overall exposure when electrostatic images corresponding to successive color-resolved images are formed by effecting primary charging, image exposure and discharging, and overall exposure on a photosensitive medium which is in the form of, for example, a drum having an insulating surface layer and a photoconductive layer of Cds or like substance. The electrostatic images so formed are developed and transferred onto a sheet of transfer paper either directly or through a second drum, in superposed relationship, whereby color representation may be completed as will be apparent.

The term "grid image" used herein is a pattern dividing the original image into the form of meshes, and it should be understood that the mesh-like form is not the only possible form but any other desired pattern may be included.

The invention will become more fully apparent from the following detailed description thereof taken in conjunction with the accompanying drawings.

DESCRIPTION OF THE PREFERRED EMBODIMENTS

Figures 1, 2, 3, 4:
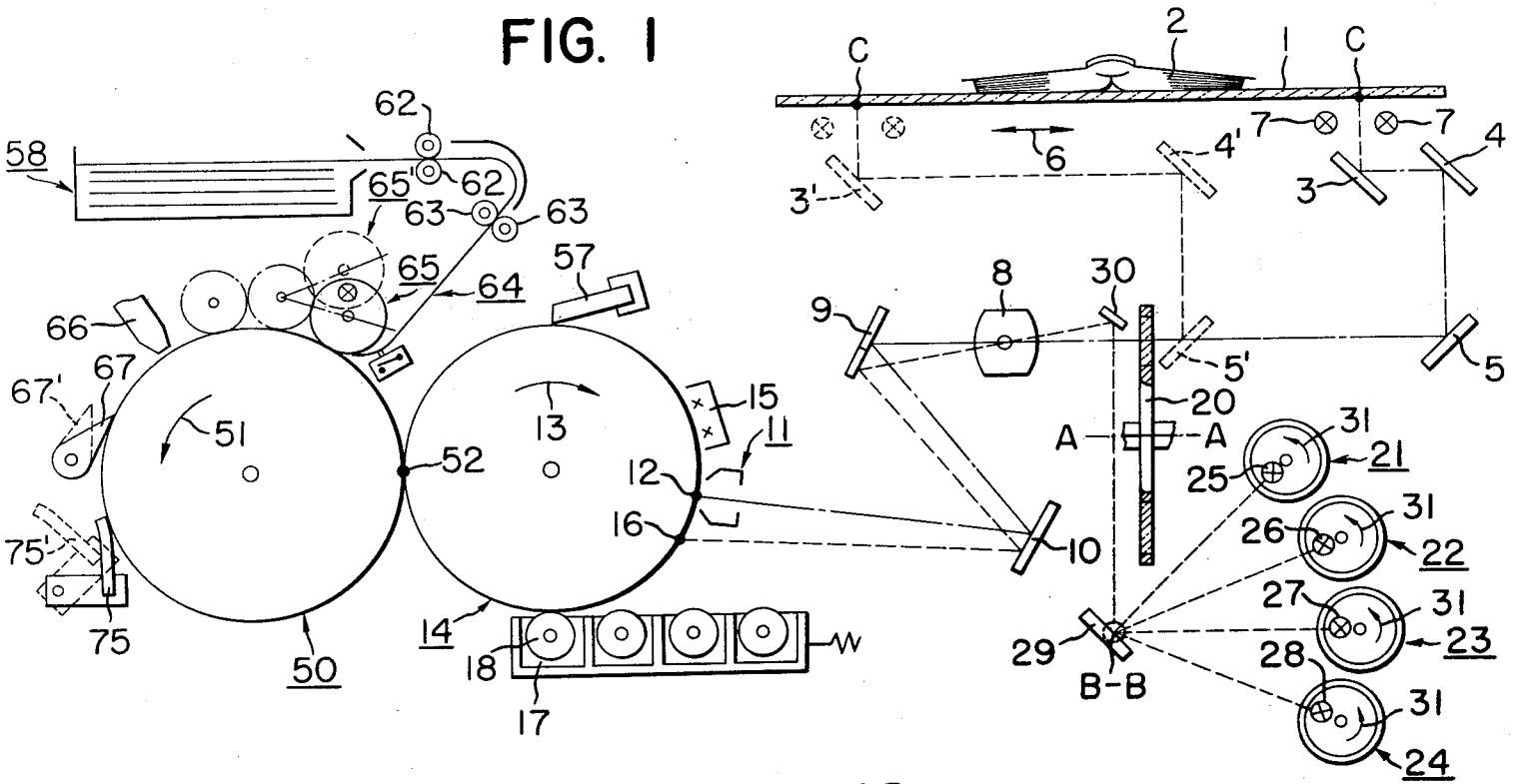
FIG. 1 schematically illustrates the construction of the apparatus according to the present invention.
FIGS. 2 to 4 illustrate the setting of screen meshes forming the grid images.

Referring to FIG. 1, an embodiment is shown of the copying apparatus according to the present invention. An original such as a book 2 supported on a transparent plate 1 is scanned by mirrors 3, 4 and 5 movable in the direction of arrow 6. A light source 7 for illuminating the original carrier is connected to the mirror 3. The mirror 3 is movable to a position 3' as it scans. The mirrors 4 and 5 are movable to respective positions 4' and 5' at half the velocity of the mirror 3. During the scanning stroke, the length of the optical path from a slit portion C to an objective lens 8 is maintained constant due to the above-described construction. Disposed after the objective lens 8 are mirrors 9 and 10, through which the optical path is arranged to direct the image of the original through a discharger 11 for simultaneous exposure and discharging and to a position 12 on a drum 14 provided with a photoconductive layer and rotatable in the direction of arrow 13. A DC corona charger 15 is disposed before the position 12 on the drum 14 and overall exposure is effected at a position 16 on the drum, whereby an electrostatic latent image is formed on the drum 14. Developer is imparted from a developer reservoir 17 to the surface of the drum 14, with the aid of a magnetic roller 18 for developing the latent image on the drum 14. Before the objective lens 8, there is disposed a filter disc 20 having a plurality of color filters which may include a grey filter. The filter disc 20 is rotatable about an axis A—A. For each individual color-resolved image to be formed, the individual color filters are successively changed over, and the original is scanned each time the change-over occurs.

The individual color filters in the filter disc 20 are operatively associated with cylinders 21, 22, 23 and 24 rotatable about their respective axes perpendicular to the plane of the drawing sheet. Light sources 25, 26, 27 and 28 are provided respectively within the cylinders.

Each of the cylinders is transparent and has a grid thereon. The directions of the grid lines on the individual cylinders are in discord with one another, as shown in FIGS. 2 to 4. A mirror 29 is rotatable about an axis B—B and may select any one of the filters and associated cylinder 21–24 each time a color-resolved image is to be formed. A mirror 30 is fixedly disposed with its projecting optical path oblique to the optical axis of the objective lens 8. Thus, the projecting optical path from the mirror 30 passes the mirrors 9, 10 and reaches the position 16 on the drum 14. Overall exposure is prevented at this grid-line image position on the drum 14 so that such grid-line image will appear as a colorless line in the image of the original.

Although each of the above-described cylinders comprises a transparent base cylinder provided with a grid, it will be apparent that it may comprise a cylindrical net or a punched metal plate.

The cylinders 21, 22, 23 and 24 are rotatable in the direction of arrow 3 in synchronism with the drum 14 during projection so that a corresponding grid image lies at the position 16.

A visible image developed from a color-resolved image of the original formed on the drum 14 is transferred from the drum 14 to a drum 50 which is rotating in the direction of arrow 51. The drum 50 is in line-contact with the drum 14 at 52 and rotated at the same velocity as the drum 14.

The manner in which color representation is effected by the above-described apparatus will further be explained. For the projection of a first color-resolved image, a color filter corresponding to the first color-resolved image is turned in the projecting optical path from the original, and the original is projected to the position 12 on the drum 14. The mirror 29 is rotated so that the grid of the cylinder 21 is projected to the position 16 on the drum 14. A developer corresponding to the first color-resolved image is imparted to the drum 14 and the developed image is transferred to the drum 50, whereafter the drum 14 is cleaned and newly charged by the DC corona charger 15. During that while, another color filter is turned in the projecting optical path to permit the projection therethrough of a second color-resolved image. In this case, the mirror 29 is rotated until the grid of the cylinder 22 is projected to the position 16 on the drum 14. The developer reservoir 17 with the magnetic roller 18 is now replaced by a new one containing therein a developer corresponding in color to the second color-resolved image, and the developed image is again transferred onto the drum 50. Such steps are repeated in accordance with the number of color-resolved images formed. The visible images formed on the drum 14 are transferred onto the drum 50 in superposed relationship. The cleaner 57 cleans the surface of the drum 14 to remove any residual developer therefrom, whereafter the surface of the drum 14 is newly charged by the corona charger 15.

When the superposition transfer of the color-resolved images onto the drum 50 is completed, a sheet of copy paper 64 is fed from a paper supply cassette 58 to the drum 50 by means of feed rollers 62, 63. A heated roller 65 is turned from its broken-line position 65' toward the drum 50 so that the copy paper passes between the heated roller 65 and the drum 50. The heated roller urges the copy paper against the drum 50 to thereby impart a flow of heat to the drum 50 through the copy paper, whereby the developers of the transferred visible images existing in superposed relationship on the drum 50 are melted. The copy paper attracts thereto the melted toner particles to provide a copy image. A blower 66 subsequently disposed cools down the melted toner for fixing. The copy paper is separated from the drum 50 with the aid of knife 67 pivotable from its position 67' toward the drum 50. If the drum 50 is coated with, for example, a layer of Teflon, the separation of the copy paper from the drum 50 will be made more effectively. Also, the Teflon layer conveniently serves to prevent the melted toner from adhering to the drum 50.

A cleaner 75 for the transfer drum 50 is connected after the knife 67, and this cleaner 75 is pivoted for operation only after the copy paper has been separated from the drum 50 with the aid of the knife 67. Thus, the cleaner 75 removes any residual toner from the drum 50. The apparatus of the present invention, as has been described with respect to a specific embodiment, enables good half-tone representation to be accomplished by simple process steps. Further, the apparatus is compact in construction and enables good half-tone representation to be accomplished at high speeds. Moreover, the apparatus is excellent in that it can realize good color representation free of moire stripes.

It should be understood that the present invention is not restricted to the above-described embodiment and that various modifications may be made within the spirit of the invention as defined in the appended claims.

I claim:

1. An electrophotographic method for reproducing a multicolor half-tone image using a photosensitive medium having an insulating surface layer, said method comprising the steps of:

applying a primary charge by uniformly charging the surface of said photosensitive medium; then applying a second charge to the primary-charged surface of the photosensitive medium, wherein said second charge is applied by an AC corona discharge or by a DC corona discharger having an opposite polarity to that of said primary charge, and simultaneously therewith or therebefore or thereafter, exposing said surface to a color-resolved image of an original; then projecting a screen image upon said surface of said photosensitive medium thereby forming a resultant electrostatic image on said surface; then transferring the electrostatic image formed on said photosensitive medium onto an image supporting member either after said image is developed on said photosensitive medium, or directly after which said image is developed on said supporting member; and then repeating said steps in accordance with a predetermined number of colors to be represented to form a superposed multicolor image on the supporting medium, wherein each screen image projection step is performed by projecting a different screen image pattern to prevent moire in the superposed multicolor image.

2. An electrophotographic method for reproducing a multicolor image as set forth in claim 1, wherein each step of projecting a screen image upon the surface of the photosensitive medium is performed by projecting a different screen pattern through a different grid.

3. An electrophotographic method for reproducing a multicolor half-tone image using a photosensitive medium, comprising the steps of:

sensitizing the photosensitive medium; then exposing a surface of the thus sensitized photosensitive medium to a color-resolved image of an original to form an electrostatic image on said surface;

projecting a screen image upon said surface of said photosensitive medium, wherein said screen image projecting step and said original exposing step are performed at different times; and then transferring the resultant electrostatic image formed on said photosensitive medium onto an image supporting member either after said image is developed on said photosensitive medium, or directly after which it is developed on the image supporting member; and then repeating said steps in accordance with a predetermined number of colors to form a superposed multicolor image on the supporting medium, wherein each repetition of said step of projecting a screen image upon the surface of said photosensitive medium is performed with a different screen image pattern to prevent moire in the superposed multicolor image.

4. An electrophotographic method for reproducing a multicolor image as set forth in claim 3, wherein each step of projecting a screen image upon the surface of the photosensitive medium is performed by projecting a different screen pattern through a different grid.

* * * * *